US006319145B1

(12) United States Patent
Coughlan

(10) Patent No.: US 6,319,145 B1
(45) Date of Patent: Nov. 20, 2001

(54) GAME ELEMENT RETRIEVAL

(76) Inventor: Terry J. Coughlan, 58 Trillium Court, Omemee, Ontario (CA), K0L 2W0

( * ) Notice: Subject to any disclaimer, the term of this patent is extended or adjusted under 35 U.S.C. 154(b) by 0 days.

(21) Appl. No.: 09/599,942

(22) Filed: Jun. 23, 2000

Related U.S. Application Data

(63) Continuation of application No. 09/121,969, filed on Jul. 24, 1998, now abandoned.

(30) Foreign Application Priority Data

Dec. 8, 1997 (CA) ..... 2224029

(51) Int. Cl.[7] ..... A63B 69/36; A63B 57/00
(52) U.S. Cl. ..... 473/197; 273/407
(58) Field of Search ..... 273/407; 473/197, 473/432, 478, 474

(56) References Cited

U.S. PATENT DOCUMENTS

| | | | | |
|---|---|---|---|---|
| 331,756 | | 12/1885 | Baker . | |
| 920,907 | | 5/1909 | Bolton . | |
| 2,899,208 | | 8/1959 | Wallsteiner . | |
| 2,923,547 | * | 2/1960 | Heeremans | 473/421 |
| 3,776,550 | | 12/1973 | McNabb . | |
| 4,083,562 | * | 4/1978 | Zepper | 473/478 |
| 4,286,786 | * | 9/1981 | Papadopoulos | 473/432 |
| 5,184,814 | | 2/1993 | Manning . | |
| 5,193,802 | | 3/1993 | Saltus . | |
| 5,269,527 | | 12/1993 | Noval . | |
| 5,308,083 | | 5/1994 | Grunfeld et al. . | |
| 5,368,292 | | 11/1994 | Metz . | |
| 5,393,049 | | 2/1995 | Nelson . | |
| 5,433,433 | * | 7/1995 | Armell | 473/478 |
| 5,569,094 | * | 10/1996 | Macaluso | 473/197 |
| 5,609,528 | | 3/1997 | Kehoe . | |
| 5,746,670 | | 5/1998 | Brady . | |

OTHER PUBLICATIONS

Golf Around the World—Wholesale Catalogue 1396 N. Kellen Dr., Lake Park, FL 33403.
Infini–Tee Catalogue—World Sports Products Inc. Trendsports.
Golden Shine Corporation Inc. CA 92807 USA #253 Ball on Net.
Gold Medal Recreational Products—Catalogue 996–G. Blue Mountain, AL; Cerritos CA; S. Hackensack NJ.
Sun Ray Sports Co. Ltd. Head Office: Taipei, Taiwan Roc.
Golf Quiknet—Noval Enterprises Mill Valley, CA 94941.
Skillbuilder—Premier Net Kit Tulsa, OK 74129.
Skillbuilder—Pro Golf Net Tulsa, OK 74129.
The Ultimate Instant Golf Net J.C. International Napa CA. 94558.

* cited by examiner

*Primary Examiner*—Jeanette Chapman
*Assistant Examiner*—M. Chambers
(74) *Attorney, Agent, or Firm*—James E. Gastle

(57) ABSTRACT

Disclosed herein is a device for retrieving a launched game element comprising frame arrangement defining an enclosure; the enclosure having an opening. The frame arrangement has a number of frame members each of which having a pair of ends. A pair of anchor portions are provided for anchoring one end of each of the frame members and each of the anchor portions is located near a corresponding side of the opening.

8 Claims, 5 Drawing Sheets

GAME ELEMENT RETRIEVAL

The application is a continuation of application Ser. No. 09/121,969 filed Jul. 24, 1998 is incorporated herein by reference now abandoned.

BACKGROUND OF THE INVENTION

1. Field of the Invention

The present invention relates to games involving the launching of a game element and more particularly to the game of golf.

2. Description of the Related Art

The game of golf is arguably the fastest growing sport in the industrialized world. Along with this growth is the need for accessories to help the golfer improve his game. While the game is played outdoors, there is increasing desire to practice the game indoors. There are several commercially available products which can 'catch' the ball driven from a tee inside a relatively confined space. However, these products have several shortcomings.

It is an object of the present invention to provide a novel retrieval device.

SUMMARY OF THE INVENTION

Briefly stated, the invention involves a device for retrieving a launched game element, comprising frame means defining an enclosure; said enclosure having an opening; said frame means having a number of frame members each of which having a pair of ends; a pair of anchor portions for anchoring one end of each of said frame members; and each of said anchor portions being located near a corresponding side of said opening.

In another aspect of the present invention, there is provided a golf ball playing installation, comprising the device as defined above together with means for establishing a tee off location in front thereof.

BRIEF DESCRIPTION OF THE DRAWINGS

Several preferred embodiments of the present invention will now be described, by way of example only, with reference to the appended drawings in which.

DESCRIPTION OF THE PREFERRED EMBODIMENTS

Referring to the figures, there is provided a retrieval device 10, in this case for retrieving launched game elements. The term "launched game elements" is intended to refer to those game elements which are thrown, driven, kicked or otherwise launched airborne in some similar fashion, such as balls for example. In this particular case, the game elements are in the form of golf balls driven by a player user, for example from a designated "tee off" location.

Figure 1:
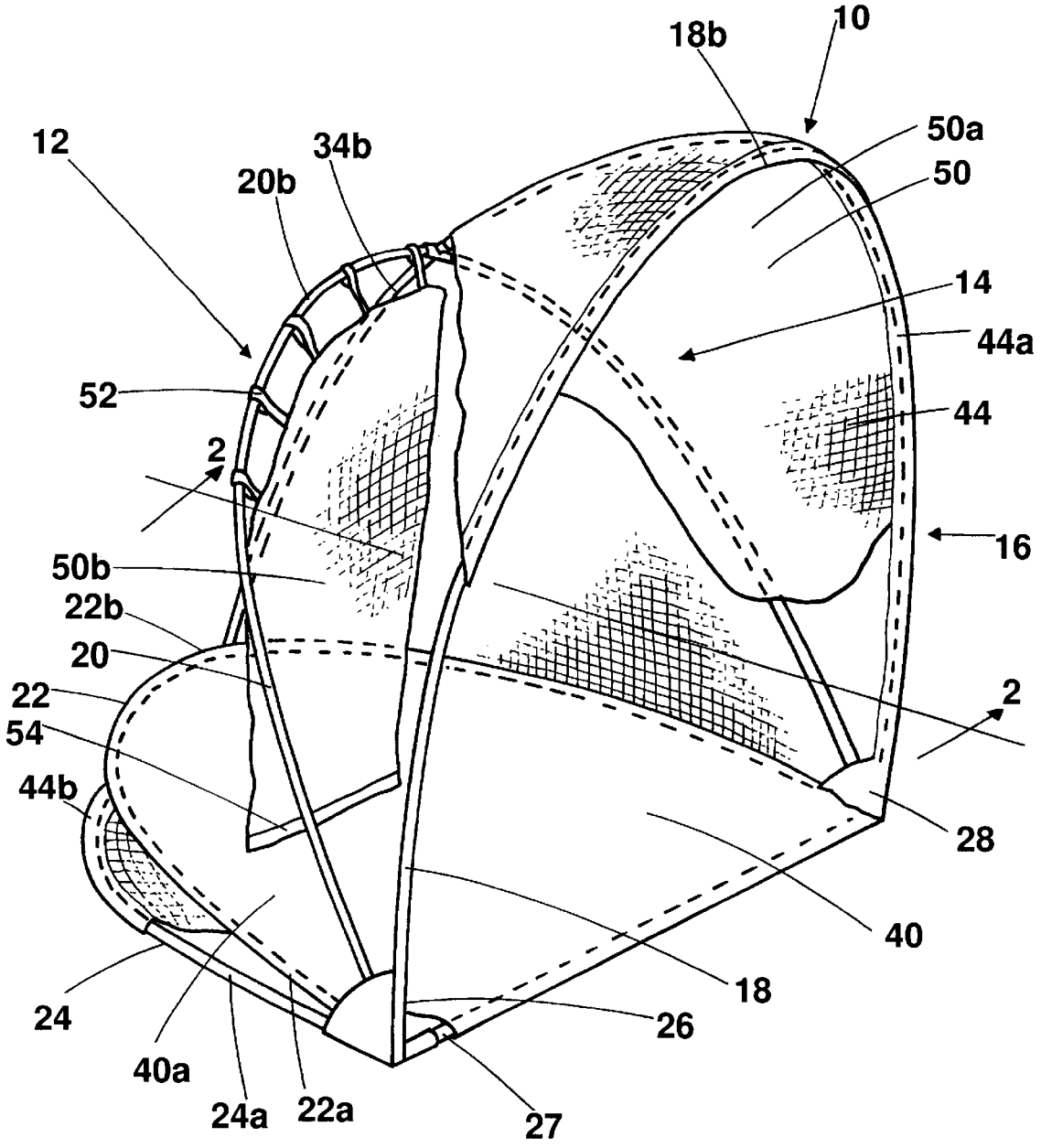
FIG. 1 is a fragmentary perspective view of a golf ball retrieval device.

The device comprises frame means 12 defining an enclosure 14, the latter of which has an opening 16. The frame means has a number of frame members 18, 20, 22, and 24, each of which has a pair of ends. A pair of anchor portions 26, 28 are also provided for anchoring one end of each of the frame members. As will be seen in FIG. 1, each of the anchor portions are located near a corresponding side of the opening 16, which provides particular benefits as shall be described. The anchor portions are joined together by a lateral base member extending therebetween as shown at 27.

The frame members have a pair of longitudinal portions 18*a*–24*a* and a lateral portion 18*b*–24*b*, the longitudinal and lateral portions defining the periphery of the enclosure. In this case, the longitudinal and lateral portions are integrally formed in the generally rounded U shape of each frame member. The longitudinal portions are arranged in two groups, each group being engaged with a corresponding end of the lateral portions and each group being fixed relative to a corresponding anchor portion.

Figure 2:
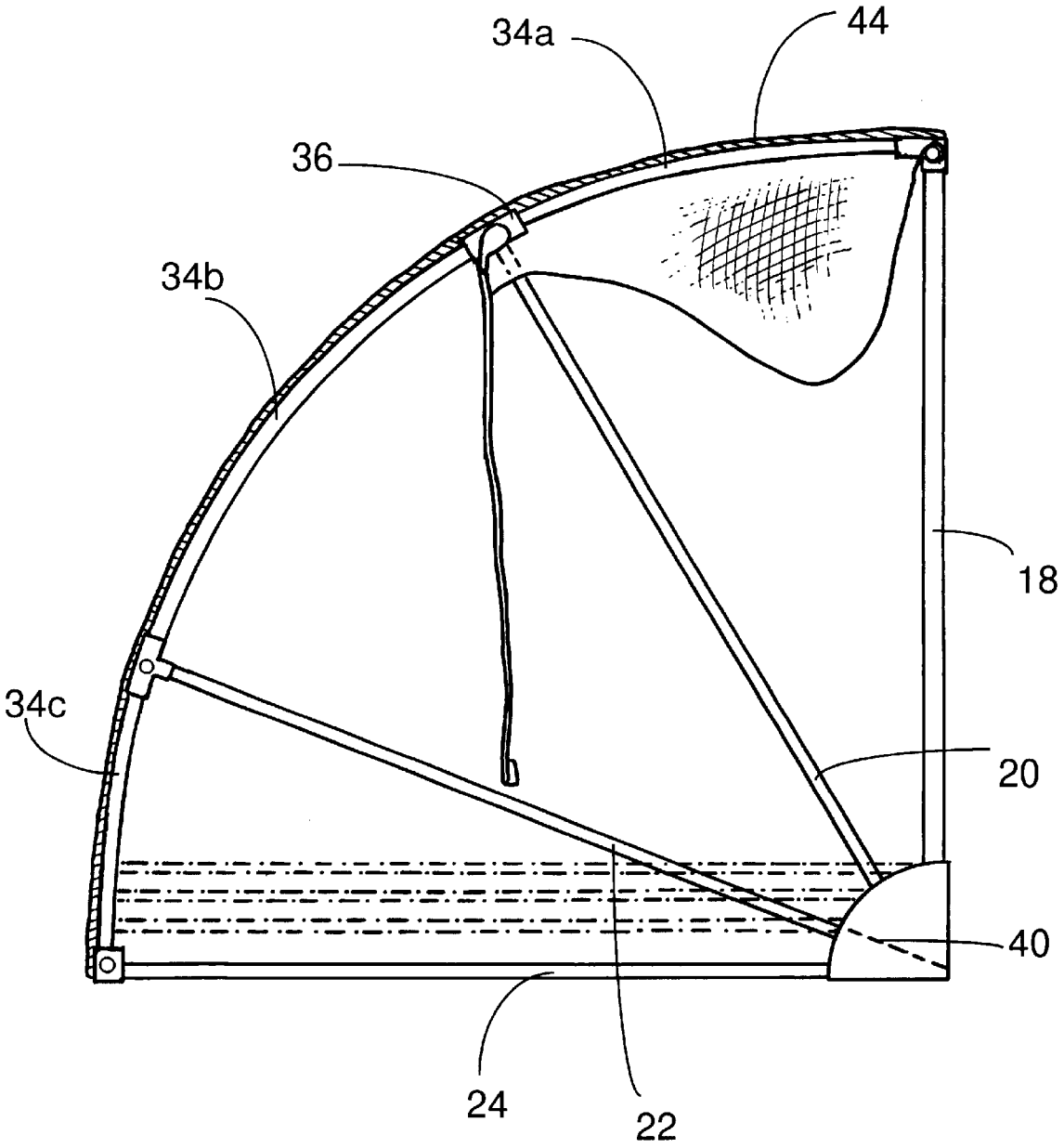
FIG. 2 is a sectional view taken on line 2—2 of FIG. 1.
Figure 3:
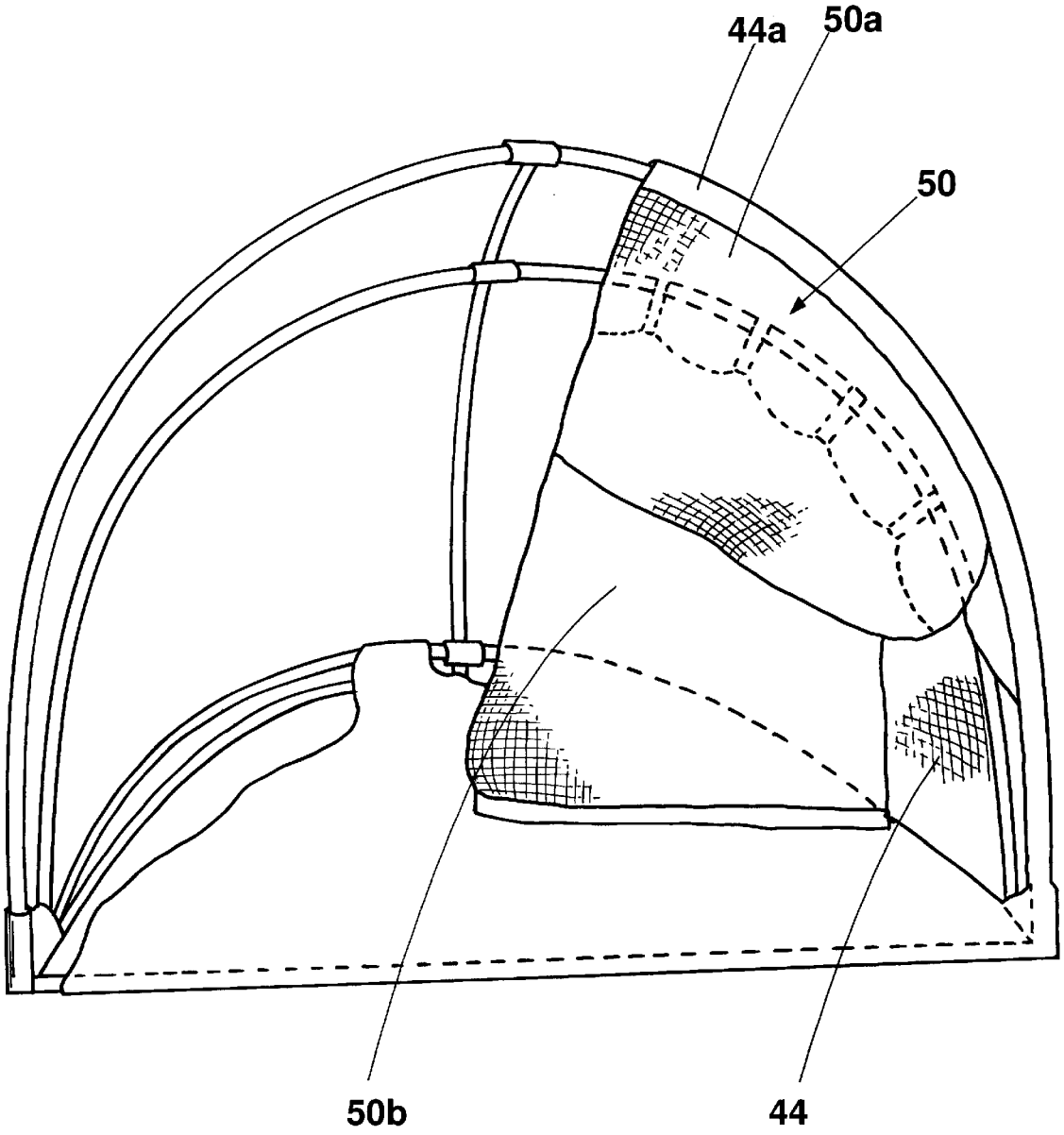
FIG. 3 is a front view of the device of FIG. 1.

The lateral portions are arranged to provide the enclosure with a substantially semicircular longitudinal cross section as can be seen in FIG. 2, and the longitudinal and lateral portions are arranged to provide the enclosure with a substantially semicircular lateral cross section as seen in FIG. 3. This longitudinal semicircular cross section may be varied by varying the length of the longitudinal portions and the lateral cross section by changing the shape of the frame members themselves.

Figure 4:
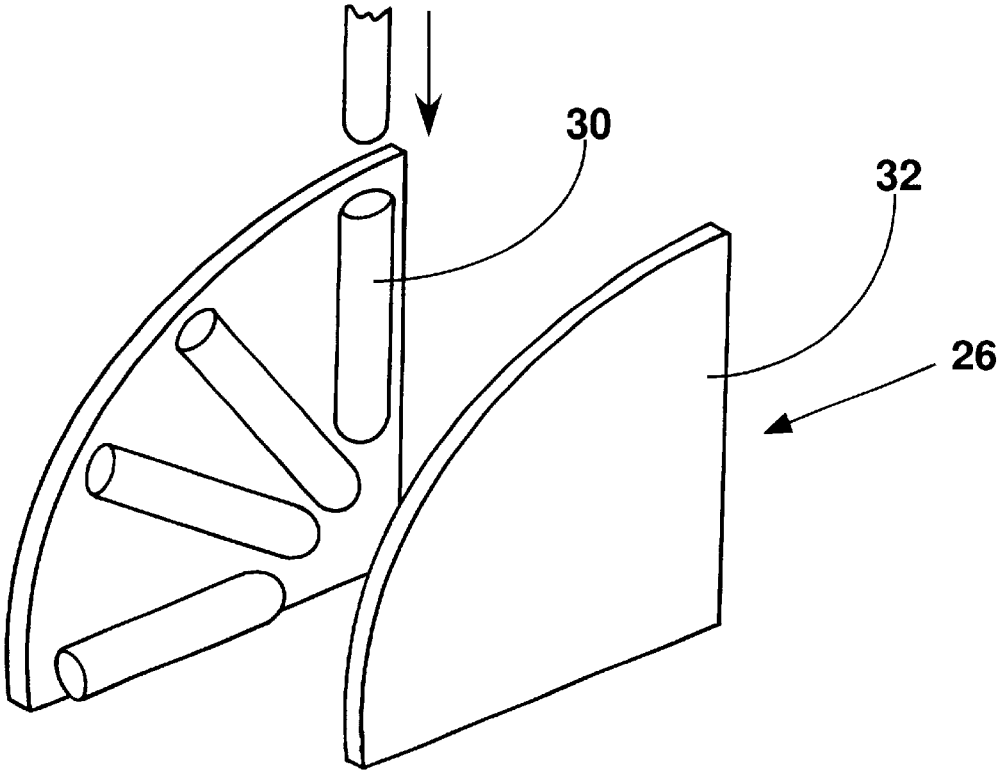
FIG. 4 is a fragmentary perspective assembly view of a portion of the device of FIG. 1.

Referring to FIG. 4, the anchor portions 26 conveniently include a number of formations 30, each in the form of a sleeve member which is arranged to engage one end of a corresponding longitudinal portion, that is to receive the end in sliding engagement therewith. The sleeve members are mounted between a pair of plate members 32 and held in position therein by fasteners such as rivets, screws or by bonding and the like. If desired, the sleeve members may be mounted for movement relative to the plate members, thereby allowing for adjustments in the relative positions of the frame members. This may include movement between a collapsed position as shown in dashed lines in FIG. 2 and an operative position as shown in solid lines therein. The frame members may also, if desired, be attached directly to the plate members without the need for the sleeve members.

Figure 4A:
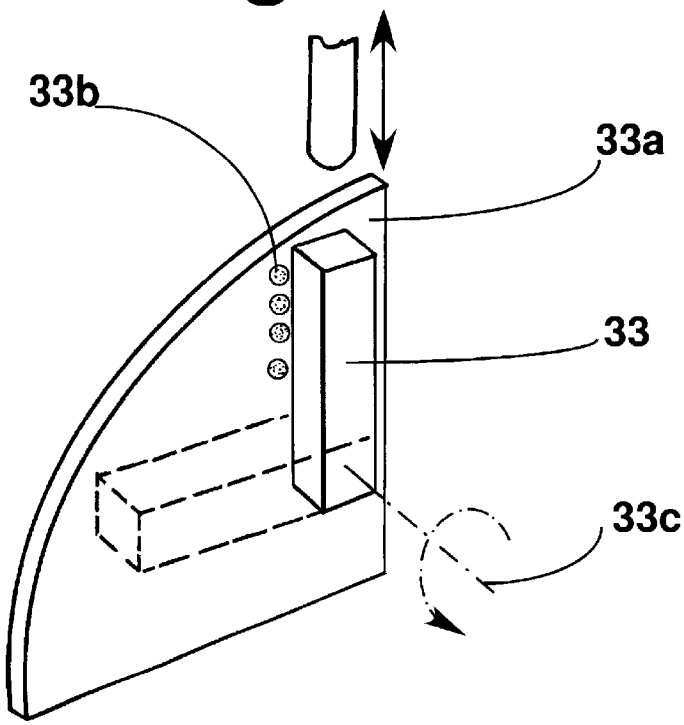
FIG. 4*a* is a fragmentary perspective assembly view of an alternative portion to that shown in FIG. 4.

If desired, the sleeve members may be of other forms such as a rectangular cross section as shown for one sleeve member at 33 in FIG. 4*a*. If desired the sleeve member may be fixed to a single plate as shown at 33*a* either by welding 33*b* or some other kind of fixed connection such as by threaded fasteners and the like. As with the sleeves 30, the sleeve member 33 may also be movable relative to the plate 33*a*, for example through pivot axis as shown schematically at 33*c*.

Figure 5:
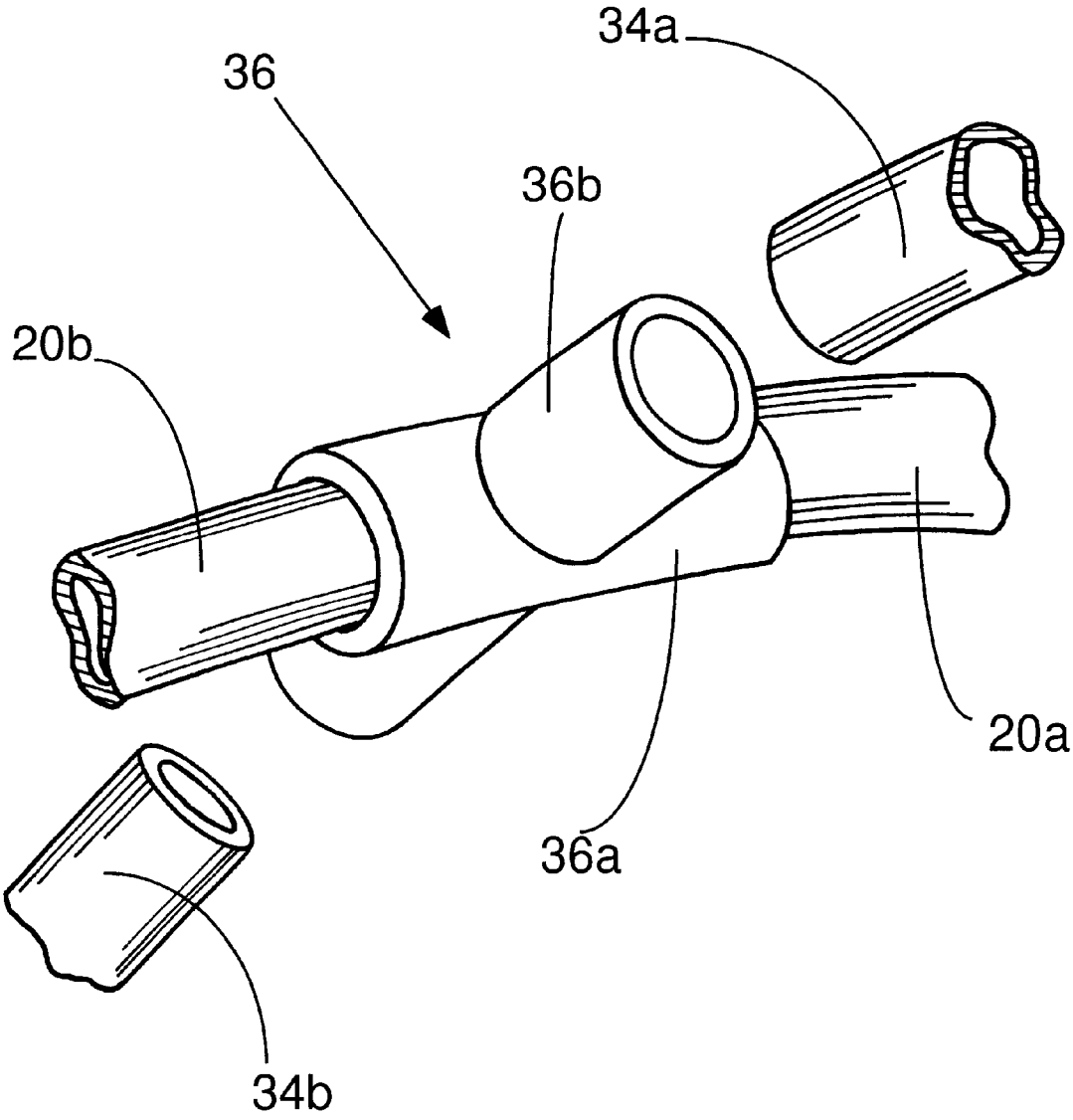
FIG. 5 is a fragmentary perspective view of another portion of the device of FIG. 1.

Extending longitudinally along the device and engaging each of the frame members are spine members 34*a* to 34*c* and attached to a central location on each by way of a coupling 36 as shown in FIG. 5 having a lateral section 36*a* which encircles the lateral portion of the frame member, in this case 20*b*, and a pair of longitudinal sections 36*b* to receive the end of spine members 34*a*, 34*b* therein. If desired, spine members 34*a*, 34*b*, 34*c* may be replaced with a single spine member engaged to an outer region of one or all of the frame members.

A ball return panel 40 positioned on the frame member 22 and which is inclined relative to a ground surface, and downwardly toward the opening. Preferably, the panel is a flexible material such as a reinforced vinyl material with a peripheral region, the peripheral region engaging the frame member. For example, the sheet of vinyl material 40*a* may be stitched along its periphery around the frame member or be held thereto in a number of other fastening techniques as required.

Conveniently, a sheet of netting material 44 is supported by the frame members, that is by being draped over the frame members. The netting material has a front peripheral region which is stitched to a front end section 44*a* which is in turn stitched around the frame member 18 and has a rear peripheral region 44*b* which is stitched to a similarly arranged rear vinyl end section which is stitched to the frame member 24.

Also provided is a catch sheet supported within the enclosure for catching a launched game element therein, in the form of a ball catch net 50, also formed preferably from netting material which is suspended from at least one of the frame members in a central region of the enclosure. In this case, the catch net 50 includes a first portion 50*a* extending rearwardly from a frame member positioned near the opening, in this case extending rearwardly from the front end section 44*a* toward the frame member 20 and a second portion 50*b* which extends downwardly from a central one of the frame members, in this case suspended from the frame member 20. The catch net includes a plurality of support loops 52, entrained on one of the frame members, in this case frame member 20. The second portion is, in this case, simply hanging from the support loops and has a lower section shown at 54 to bias the net downwardly toward the ball return panel 40.

The golf ball retrieval device may be used in the following manner. First, the device is assembled as shown above and then is positioned a distance from a designated "tee off" location which itself can vary from something as simple as a designated location a few yards away and, if desired, denoted by the presence of a "tee" or something as sophisticated as a commercially available "tee off" pad. Next, the player hits the ball into the device causing the ball to contact the netting material, such as the ball catch net 50. This causes the ball to decelerate until it engages the panel 40*a* and, by the force of gravity, rolls back toward the opening 16 and back toward the "tee off" location that is, to an outside location beyond the opening 16.

The golfball retrieval device 10 thus provides a technique whereby a golfball can be retrieved in a convenient manner. The shape of the enclosure can be varied by varying the length and shape of the frame members. The anchor portions being adjacent the opening provide for a relatively simple design since the anchor portions are able to support, in this case, all of the frame members in place. The device can be made still simpler by omitting the central spine members if desired, simply by providing a robust attachment at the anchor portions. The device can, if desired, be made collapsible, for example by arranging the frame members to be movable relative to the anchor portions, as exemplified in FIG. 4*a*. Furthermore, the ball return panel 40 can be angled higher or lower as desired.

While the device 10 has been described with respect to the game of golf, it will be understood that the device may have use in other sports which involve a game element such as a ball, being thrown, driven, kicked or otherwise launched in some fashion where retrieving the ball is desirable and advantageous. The types of materials used in the fabrication of the device will reflect its use and may be more substantial in some cases than in others.

What is claimed is:

1. A device for retrieving a launched golf ball comprising:

an enclosure having an opening with a pair of lower corners, the opening being oriented to receive the launched golf ball;

a plurality of u-shaped frame members, each of the u-shaped frame members having a pair of legs, each of the legs having a free end region, the u-shaped frame members being aligned to form two groups of free end regions, wherein each group of free end regions is directed toward a corresponding one of the pair of lower corners;

a pair of anchor portions, each of which is located at a corresponding lower corner for anchoring a corresponding group of free end regions, wherein:

a first of said u-shaped frame members is operable to be positioned along a ground surface, a second of said u-shaped frame members is operable to be positioned in an upright orientation to border the opening; and a third u-shaped frame member is operable to be positioned at an incline between the first and second u-shaped frame members;

a fourth u-shaped frame member is operable to be positioned between the second and third u-shaped frame members;

a lower frame member which extends across a lower periphery of the opening and between the anchor portions;

a covering to lie over the u-shaped frame members;

a ball return panel positioned on the third u-shaped frame member and the lower frame member to return the launched golf ball toward the opening; and a catch net including a first portion to hang between the second and fourth u-shaped frame members and a second portion to hang from the fourth u-shaped frame member above the ball return panel to decelerate the launched golf ball after it enters the enclosure.

2. A device as defined in claim 1 wherein either the first u-shaped frame member or the second u-shaped frame member or both are pivotally attached to said anchor portions.

3. A device as defined in claim 1 wherein the third u-shaped frame member is pivotally attached to said anchor portions.

4. A device as defined in claim 1 wherein the legs of at least two of the u-shaped frame members are pivotally coupled to the anchor portions.

5. A device as defined in claim 1 wherein each of the anchor portions has a cavity to receive the free end region of at least one of the legs therein.

6. A device as defined in claim 1 wherein said game element return panel is a flexible material with a peripheral region, said peripheral region engaging said third u-shaped frame member and the lower frame member.

7. A device as defined in claim 1 wherein said catch net portion includes a plurality of support loops to receive said fourth u-shaped frame member.

8. A device as defined in claim 1, further comprising at least one central frame member to extend laterally between said unshaped frame members from the first u-shaped frame member to the second u-shaped frame member.

* * * * *